United States Patent [19]

Paredes

[11] Patent Number: 5,076,137

[45] Date of Patent: Dec. 31, 1991

[54] DYNAMIC ACTION COMPENSATOR FOR HANDGUNS

[76] Inventor: Samuel A. Paredes, 101 Rambling Dr., Folsom, Calif. 95630

[21] Appl. No.: 581,787

[22] Filed: Sep. 13, 1990

[51] Int. Cl.[5] ..... F41A 21/36
[52] U.S. Cl. ..... 89/14.3
[58] Field of Search ..... 89/14.3; 42/1.06

[56] References Cited

U.S. PATENT DOCUMENTS

| | | | |
|---|---|---|---|
| 3,808,943 | 5/1974 | Kelly | 89/14.3 |
| 4,459,895 | 5/1984 | Mazzanti | 89/14.3 |
| 4,534,264 | 7/1985 | Tarnoff | 89/14.3 |
| 4,691,614 | 9/1987 | Leffel | 89/14.3 |
| 4,715,140 | 12/1987 | Rosenwald | 42/97 |
| 4,811,648 | 2/1989 | Blackwell | 89/14.3 |
| 4,833,808 | 6/1989 | Strahan | 92/1.06 |
| 4,852,460 | 11/1989 | Davidson | 89/14.3 |

OTHER PUBLICATIONS

Dick Metcalf, "The Cream of the Crop-Top-Flight Comp Pistols", Shooting Times Magazine (Oct. 1988).

*Primary Examiner*—Michael J. Carone

[57] ABSTRACT

A compensator is described, having a primary venting system that directs high pressure gas in a downward direction, thereby creating a dynamic or resistive force as the gas bears on the bottom surface of the compensator housing before being redirected at upward angles. This primary systems works to push the compensator down thereby negating muzzle flip. A secondary venting system, which consists of one (or more) cylindrical gas expansion chamber(s) forward of the downward vent, works in combination with the primary system by allowing residual lower pressure gases to expand and disrupt within the expansion chamber(s) before being vented in an upward direction. This secondary system creates a passive action in that the gas is not directed to bear on any particular surface, but is allowed to expand and bear on all available surfaces before venting upwards thereby creating an additional downward force further reducing muzzle flip.

2 Claims, 7 Drawing Sheets

DYNAMIC ACTION COMPENSATOR FOR HANDGUNS

FIELD OF THE INVENTION

This invention relates to the reduction or elimination of the reaction known as muzzle flip which results when a handgun is discharged. More particularly, this invention utilizes propellant gases to create a combination of dynamic (resistive) and passive actions to reduce muzzle flip in discharged handguns. Even more specifically, this invention relates to a device attached to the end of the barrel of a handgun which redirects high pressure propellant gases through a downward port, forcing them to bear on the bottom surface of the device and allows residual lower pressure gases to enter one or more cylindrical expansion chambers.

BACKGROUND OF THE INVENTION

The problem of controlling the recoil action known as muzzle flip, subsequent to discharging a handgun, in order to fire successive shots in a rapid and accurate manner is well known. The recoil effect is created by two major contributing factors. The first factor is physical in nature. When a handgun is discharged, propellant gas, which pushes a projectile through the barrel, creates a high pressure jet action upon exiting the muzzle, thereby creating a rearward push on the firearm. This action is much like the thrust created by jet engines. The second major contributing factor is inherent in the actual design of handguns in general. Virtually, all semi-automatic pistols and revolvers have the axis of the barrel bore (from muzzle to breach) on a horizontal plane above the handgun grip and the axis of the grip intersects the barrel axis at a near vertical angle. Thus, a pivot point is created at the place where the axis of the barrel intersects the axis of the grip. When a handgun is discharged, the rearward force causes the muzzle end to flip upwards above the described pivot point which is at the breech end of the barrel axis.

Various attempts have been made to reduce or eliminate the recoil action in handguns. These include the use of metered ports positioned at upward angles on the barrel (U.S. Pat. No. 3,808,943—Kelly), tubular chambers (U.S. Pat. No. 4,459,895—Mazzanti), side ports (U.S. Pat. No. 4,534,264—Tarnoff et al.), compensators with symmetrical and unsymmetrical upward facing ports used in combination with an expansion chamber (U.S. Pat. No. 4,691,614—Leffel et al.), weighted compensators with upward exhaust ports receiving slotted and slidable bushings (U.S. Pat. No. 4,715,140—Rosenwald), muzzle brakes which attach to barrels at the muzzle with a combination of upward facing pressure ports and a conical expansion chamber with a strike plate having a truncated planar surface (U.S. Pat. No. 4,811,648—Blackwell et al.), anti-recoil devices which use gas pressure to move weights, surrounding the barrel and contained within a barrel extension, in a forward motion (U.S. Pat. No. 4,833,808—Strahan), muzzle brake systems which use expanded chambers and a plurality of openings on the upper portion of the barrel (U.S. Pat. No. 4,852,460—Davidson). Also, a gun leveling device which captures gases from a rifled barrel through a plurality of radially arranged passages in the barrel into a circumferential expansion chamber defined between the barrel and shroud (U.S. Pat. No. 4,058,050—Brouthers), and a device to fit on the end of a barrel as an extension, forming a chamber designed to baffle the gases with one or more apertures, which may be rearwardly inclined, and having an inner box to close the said opening and captures gases which are directed downward into the chamber (U.S. Pat. No. 4,465,697—Johnston).

Previous art examples are also found in articles titled "The Cream of the Crop—Top-Flight Comp Pistols" (Metcalf) published in "Shooting Times Magazine—October 1988" and "Wilson Super Grade" (Hopkins) published in "American Handgunner Magazine—July/August 1989". These articles depict various examples of the accepted state-of-the-art designs which include the use of muzzle weights, forward angled deflection chambers (Clark), compensators with variously designed expansion chambers combined with upward ports or openings (Nastoff, Liebenberg, Brown, Heine, McCormick, Plaxco, and Wilson), and an increasing number of compensator designs using two or more expansion chambers with upward facing ports or openings (Wilson, Hammond, Kempton, Voight, Malloy, Huening).

The purpose of a compensating device is to allow a shooter to fire a handgun quickly and accurately. Of those existing designs, a combination of problems occur: (1) Either the systems are not sufficiently efficient in reducing recoil and muzzle flip; (2) the systems disrupt high pressure gases in an expansion chamber thereby causing a substantial disturbing force behind and around the projectile potentially affecting terminal accuracy; (3) or the systems cause too much forward force on the end of the barrel of a semi-automatic handgun. The result being that the barrel remains locked-up in battery within the slide for so long, in order to reduce barrel pressures, that the slide cycle time is reduced to the point where the shooter is limited in quick follow-up shots by cycle limits of the slower slide. This problem is mitigated to some extent with the use of lighter recoil springs, but this is at the expense of reduced reliability in the functioning of the handgun, or by reducing the weight of the slide in some fashion with the net result of an increased expense.

SUMMARY OF THE INVENTION

There has not heretofore been a compensator system provided which utilizes high pressure gas directed in a downward fashion from the barrel to cause a positive dynamic (resistive) action on a bottom surface, in combination with one (or more) forward cylindrical expansion chamber(s) which is utilized by lower pressure residual gas vented in an upward direction, thereby creating a passive action to substantially reduce or eliminate the muzzle flip of a handgun.

Accordingly, it is the purpose of this invention to provide a compensating system which substantially reduces or eliminates muzzle flip through the use of a unique downward porting system for high pressure propellant gas, causing a dynamic (resistive) action. This is a result of the directed gas bearing on the bottom surface of the compensator before being forced to jet at upward angles through side vents. It is also the purpose of this invention to provide one or more cylindrical expansion chambers, forward of the high pressure downward port, to allow residual gas to expand and disrupt at lower pressures before being allowed to vent upwards through an unobstructed opening(s). The result of which creates a substantially reduced disturbance behind the projectile so as to reduce the negative affect on terminal accuracy. This also serves to reduce the amount of forward force placed on the forward surface of the expansion chamber(s) allowing the slide cycle time to remain at near normal speed and reducing the necessity to substantially lighten the slide and the recoil spring system to maintain cycle speed and reliability.

BRIEF DESCRIPTION OF THE DRAWINGS

The invention will be better understood when reference is made to the following drawings.

LIST OF REFERENCE NUMERALS

1: Single expansion chamber compensator device.
1A: Double expansion chamber compensator device.
2: Upward angled side vents.
2A: Side vent angle.
3: Single expansion chamber.
3A: Double expansion chamber.
4: Barrel.
5: Threaded portion of barrel to accept compensator device.
6: Complete recoil spring assembly, spring, plug and guide.
7: High pressure propellant gas.
8: Residual lower pressure propellant gas, single expansion.
8A: Residual lower pressure propellant gas, double expansion.
9: Front sight.
10: Bottom surface of high pressure downward port.
11: High pressure downward port.
11A: Redirected high pressure propellant gas.
12: Horizontal barrel axis.
13: Vertical grip axis.
14: Recoil pivot point.

DESCRIPTION OF THE INVENTION

Figure 1:
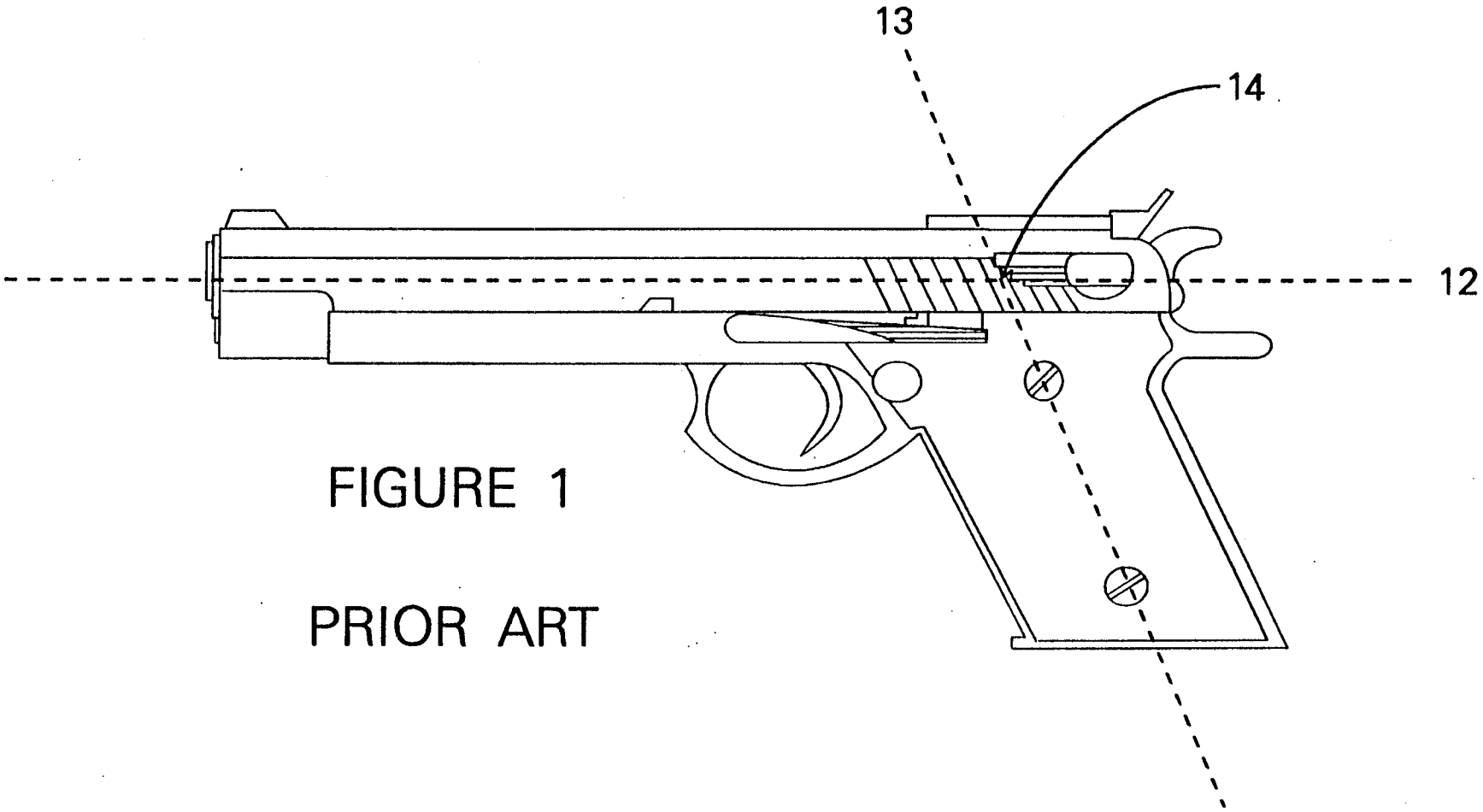
FIGURE 1 PRIOR ART
FIG. 1 is a view of a typical prior art semi-automatic handgun showing horizontal barrel axis, contained within a slide, vertical grip axis and muzzle flip pivot point.

FIG. 1 depicts an assembled typical prior art semi-automatic handgun consisting of several major components including a frame assembly, slide assembly, and a barrel and spring system which are contained within the slide. Also, shown is the horizontal axis of the barrel 12, as well as the vertical axis of the grip 13. The point where these two axis meet forms the pivot point 14 which anchors the rising muzzle when the handgun is discharged.

Figure 2:
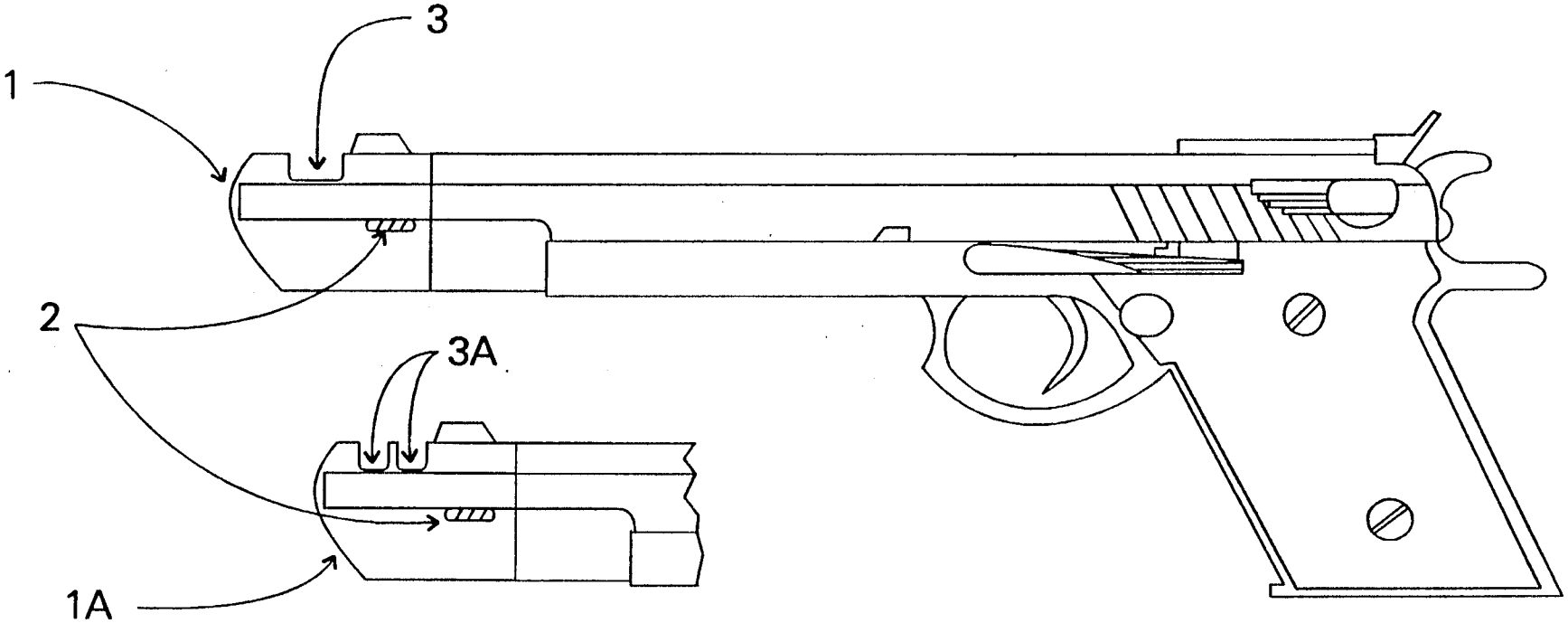
FIG. 2 is a view of a typical semi-automatic handgun with the compensator invention attached to the end of the barrel thereof.

FIG. 2 shows the typical semi-automatic handgun with an attached compensator invention 1 and 1A, with a predetermined overall length and width depending on the specific handgun and caliber to be used (generally between 1.50 and 2.00 inches in length, and width to match slide dimensions), which is designed with a unique primary downward porting system with upward angled vents on both sides of the compensator 2, and secondary cylindrical expansion chamber(s) 3 (and 3A) which begins at the muzzle of an extended length barrel.

Figure 3:
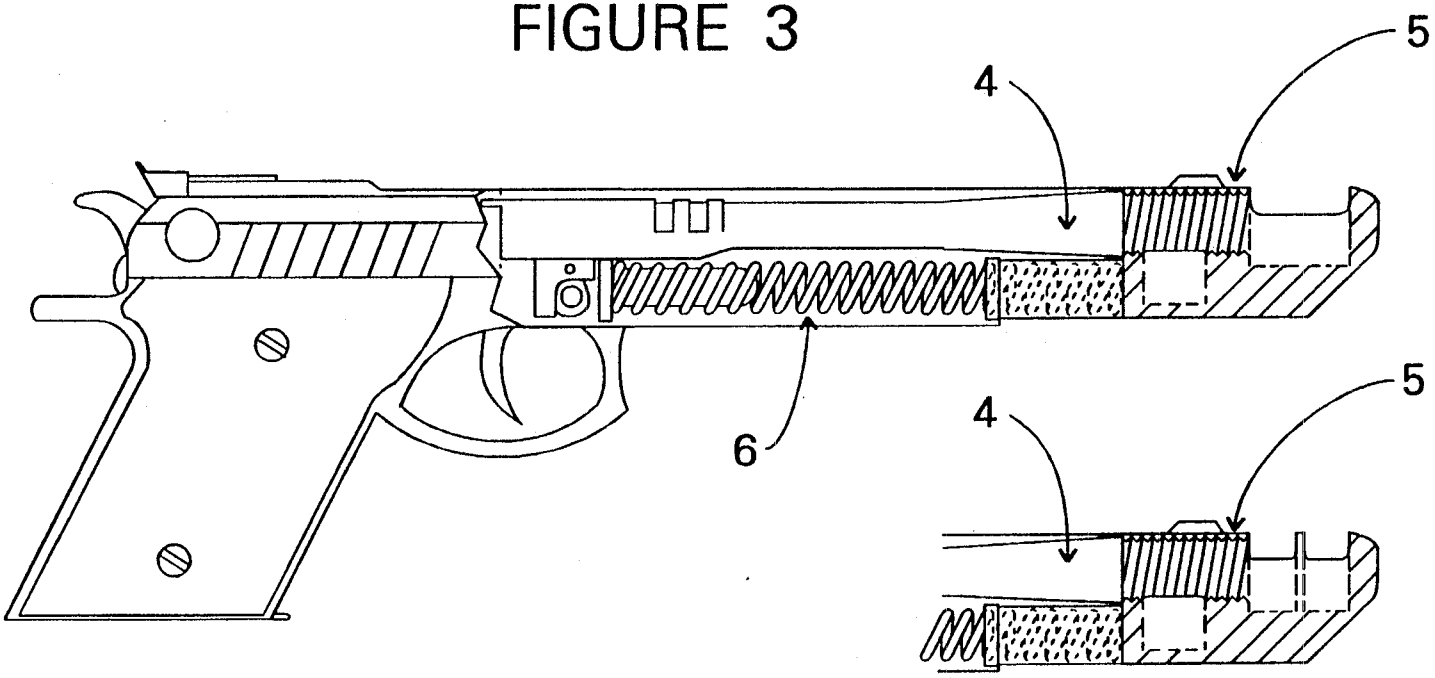
FIG. 3 is a cut-away view of a semi-automatic handgun and compensator invention showing barrel, recoil spring system and mode of attachment of compensator invention to barrel.

FIG. 3 is a longitudinal cross-section of a typical semi-automatic handgun showing an extended length barrel 4 with a conically shaped outer diameter which replaces the need to align the barrel within the slide by use of a bushing (though a standard barrel and bushing unit can still be utilized). It also shows a method for attaching the compensator invention to the barrel by means of threading the forward end of the barrel 5 with matching threads on the compensator, but may also be attached by various other methods including soldering, welding, bonding, press fitting and locating with a set screw. This figure also shows a standard recoil spring system 6, which is required to cycle the slide into and out of battery.

Figure 4:
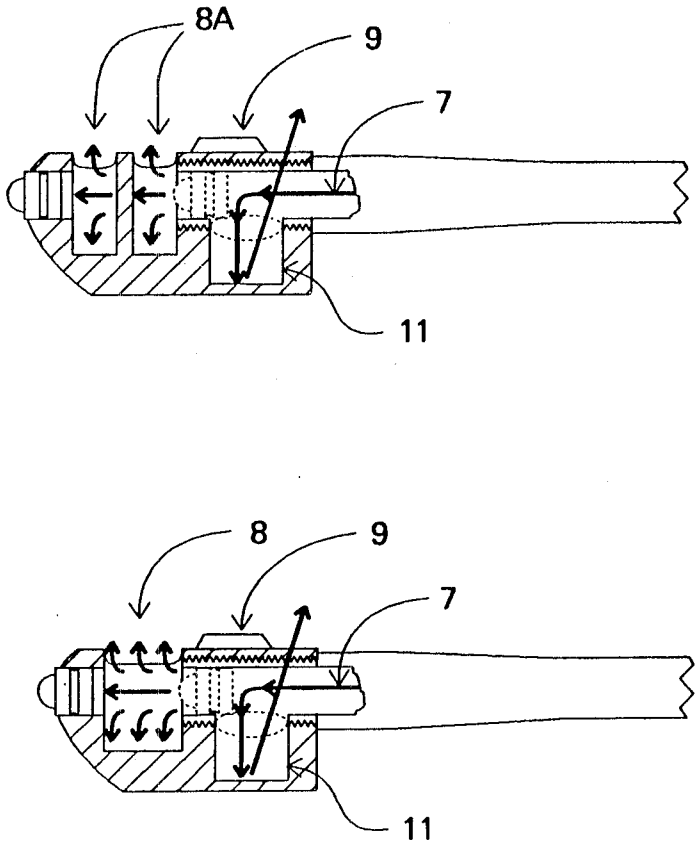
FIG. 4 is a longitudinal cross-sectional view of compensator invention showing downward port and vent, and cylindrical expansion chamber and vent.

FIG. 4 is a cross-sectional depiction of the compensator invention showing high pressure gas 7 being directed into the downward facing port 11 which measures a predetermined size depending on the caliber of the barrel, generally between 0.125 to 0.300 inches in width and 0.250 to 0.500 in length. Also depicted, is a secondary cylindrical expansion chamber 8 or chambers 8A which allows residual lower pressure gas to expand and disperse behind the projectile to bear against the walls of the chamber exerting additional, but reduced, downward force on the compensator as the gas vents in an upward direction through an unobstructed opening. This creates a passive jet action in that the low pressure gas is not directed to bear on a particular surface. Also, depicted is the location of the front sight 9 onto the compensator beneficially extending the sighting plane. This installation is not required for proper functioning of the compensator invention.

Figure 5:
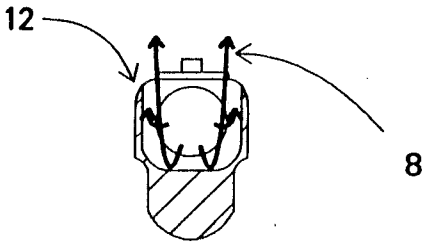
FIG. 5 is a cross-sectional view from the front of the muzzle of the compensator invention showing cylindrical expansion chamber.

FIG. 5 is a frontal cross-section of the compensator invention at the location of the expansion chamber. This depiction shows low pressure gas 8 exiting the unobstructed opening 12 on the top of the compensator invention directly above the cylindrical expansion chamber(s).

Figure 6:
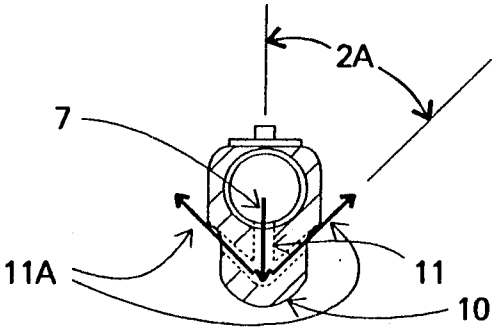
FIG. 6 is a frontal cross-sectional view of the compensator invention showing the primary downward port and upward angled vents.

FIG. 6 is a frontal cross-sectional view of the compensator invention at the primary downward port 11. This port directs high pressure propellant gas 7 from the barrel through a downward passageway and forces the gas to bear against the bottom 10 of the compensator invention, thus creating a resistive downward force on the muzzle. Then the gas is redirected 11A to jet through upward angled side vents which are executed at predetermined sizes, the combination of which will equal or surpass the volume of the downward port, at a 30 to 60 degree angle 2A from the vertical center of the compensator invention.

Figure 7:
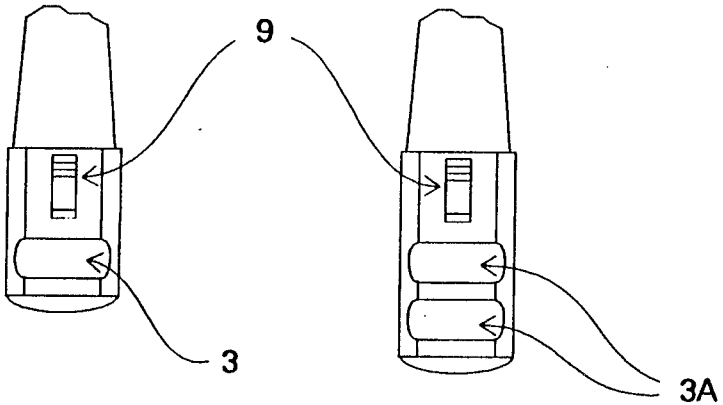
FIG. 7 is a top view of the compensator invention showing the unobstructed top vent(s) of the secondary cylindrical expansion chamber(s).

FIG. 7 is a top view of the compensator invention showing the unobstructed opening(s) of the cylindrical expansion chamber(s) 3 and 3A. The size of the chamber(s) and the opening is to be executed at predetermined sizes, ranging between 0.250 and 1.000 of an inch in length and preferably between 0.750 and 0.900 of an inch diameter in width, depending on the particular model of handgun and caliber being used.

In accordance with the patent statutes, a preferred embodiment and best mode has been executed with the following description, but the scope of the invention is not limited thereto, but rather is measured by the scope of the attached claims.

The preferred embodiment of the invention compensator was executed on an Irwindale Arms Incorporated, Model Javelina in caliber 10 mm auto. This is a near identical replication of the Colt Government Model semiautomatic pistol originally designed by John M. Browning. The length of the compensator invention is 1.600 inches. The downward port begins 0.125 inches from the back edge of the compensator invention and measures 0.250 inches in width by 0.325 inches in length. The side vents measure 0.125 inches in width by 0.325 inches in length. The distance between the forward edge of the downward port and the barrel muzzle (where the secondary expansion chamber begins) is 0.300 inches. The dimensions of the cylindrical expansion chambers measure 0.300 inches in length by 0.813 inches in diameter for the first chamber and 0.325 inches in length by 0.813 inches in diameter for the second chamber with a 0.150 inch divider. The distance between the forward edge of the expansion chamber and the front of the compensator invention is 0.300 inches.

Testing has shown that the compensator invention virtually eliminates the muzzle rise action of the embodiment when compared to non-compensated examples of the same model and when compared to prior art compensated pistols chambered in 0.45 ACP and 10 mm auto. Further tests were completed comparing the 10 mm auto embodiment and additional embodiments in 10 mm auto, 0.40 Smith and Wesson caliber and in 0.45 ACP caliber using double expansion chambered compensators. When testing the four embodiments, a benchmark was set for test ammunition in order to make comparisons based on equally powered ammunition. A power factor was established at 180 units. This power factor is measured by multiplying the projectile weight by velocity, divided by 1000. In the case of the 0.45 ACP ammunition, a 200 grain lead bullet was used propelled at 900 feet per second and in the 10 mm auto and 0.40 S&W, a 180 grain lead bullet was used propelled at 1000 feet per second. All loads equal the 180,000 power factor and are accepted on an equal footing by national and international sanctioning organizations as major power loads.

It was found that the 0.40 S&W and the 10 mm auto embodiments were slightly more efficient in reducing the muzzle rise action than the 0.45 ACP embodiment at the 180 power factor. It is theorized that because the 0.40 S&W and 10 mm cartridges create and operate at higher pressures than the 0.45 ACP cartridge, these higher pressures utilize the compensator invention more efficiently by exerting more force on all aspects of the device. When the power factor of the 0.45 ACP embodiment was raised to between 190 and 200, the difference in muzzle rise between it and the others was undetectable because it was now operating at a higher pressure level.

Although the description above contains many specificities, these should not be construed as limiting the scope of the invention but as merely providing illustrations of some of the presently preferred embodiments of this invention.

Thus the scope of the invention should be determined by the appended claims and their equivalents, rather than by the examples given.

What is claimed is:

1. A compensating device for reducing or eliminating the action know as muzzle rise in handguns comprising in combination:

(A) a replacement barrel having a compensator engaging portion adjacent muzzle end and a port opening intersecting the compensator engaging portion, the port opening having a predetermined size and facing downwardly when the barrel is securely attached to a handgun.

(B) a compensator device having an internal bore with a barrel engaging portion engaging the compensator portion of the barrel, a downward port which intersects with the barrel engaging portion such that the downward port is in alignment with the port opening of the barrel, a pair of vents originating at the downward port and extending at an upward diverging angle and providing a pair of openings on the sides of the compensator body, at least one cylindrical expansion chamber beginning at the termination of the muzzle end of the barrel coaxial with and extending away from the barrel, and at least one unobstructed and non-constricting opening beginning at the top of each expansion chamber and extending upward through the top of the compensator body; and (C) means for securely attaching the compensator engaging portion to the barrel engaging portion.

2. The compensating device of claim 1 wherein the attaching means is from the group consisting of chemical, mechanical, threaded, welded, soldered, cast or machined connection.

* * * * *